US006467384B1

(12) United States Patent
Bromley

(10) Patent No.: US 6,467,384 B1
(45) Date of Patent: Oct. 22, 2002

(54) METHOD AND APPARATUS FOR CUTTING A PRINTING BLANKET

(75) Inventor: Brian K. Bromley, Andover, MN (US)

(73) Assignee: Relief Products LLC, Chicago, IL (US)

( * ) Notice: Subject to any disclaimer, the term of this patent is extended or adjusted under 35 U.S.C. 154(b) by 0 days.

(21) Appl. No.: 09/226,565

(22) Filed: Jan. 7, 1999

(51) Int. Cl.[7] ..... B26D 7/00

(52) U.S. Cl. ..... 83/428; 83/455; 83/574; 83/698.71

(58) Field of Search ..... 83/455, 614, 574, 83/36, 733, 698.71, 249, 34, 428

(56) References Cited

U.S. PATENT DOCUMENTS

| | | | | | |
|---|---|---|---|---|---|
| 16,275 | A | * | 12/1856 | Howe | 83/455 |
| 160,613 | A | * | 3/1875 | O'Brien | 83/574 |
| 868,656 | A | * | 10/1907 | Gramelspacher | 83/455 |
| 1,215,388 | A | * | 2/1917 | Lanford | 83/614 |
| 2,747,664 | A | * | 5/1956 | Corson | 83/614 |
| 3,766,813 | A | * | 10/1973 | Pearl | 83/56 |
| 3,964,360 | A | * | 6/1976 | Schwartz | 83/614 |
| D245,967 | S | * | 10/1977 | Chartier | D10/61 |
| 4,537,582 | A | * | 8/1985 | Liu | 83/545 |
| 4,608,891 | A | * | 9/1986 | Frisby et al. | 83/698.71 |
| 4,656,904 | A | * | 4/1987 | Rayment | 83/698.71 |
| 4,700,598 | A | * | 10/1987 | Gerber | 83/14 |
| 4,741,235 | A | * | 5/1988 | Price | 83/574 |
| 5,074,178 | A | * | 12/1991 | Shetley et al. | 83/47 |
| 5,094,134 | A | * | 3/1992 | Mizukoshi | 83/698.21 |
| 5,188,009 | A | * | 2/1993 | Sunohara et al. | 83/13 |
| 5,438,896 | A | * | 8/1995 | Carroll | 83/614 |

* cited by examiner

*Primary Examiner*—Kenneth E. Peterson
*Assistant Examiner*—Stephen Choi
(74) *Attorney, Agent, or Firm*—Wallenstein & Wagner, Ltd

(57) ABSTRACT

A blanket cutter (10) used in conjunction with an offset printing press, for example. Blanket cutter (10) can include an elongated rail (12) mountable proximate to a blanket cylinder (11). Slidably supported by rail (12) is a cutter assembly (20) including a puck assembly (22) which adjustably holds a knife or tramming gauge (24). The knife (24) can be moved in and out relative to puck (22) to adjust the depth of the cut; and knife (24) can be twisted about its axis (41) to reorient the blade of the knife depending on whether the cut is horizontal (axial) or vertical (circumferential). The puck can be moved along rail (12) to make a horizontal/axial cut; and the blanket cylinder (11) can be rotated, in a preferred embodiment, to make a vertical/circumferential cut. The result is a blanket cut that is faster and more accurate than that achieved using a freehand method.

1 Claim, 3 Drawing Sheets

METHOD AND APPARATUS FOR CUTTING A PRINTING BLANKET

FIELD OF THE INVENTION

The present invention relates generally to the field of printing, and more particularly to techniques for selectively removing portion(s) of a "printing blanket" which is part of or used in conjunction with a printing machine.

BACKGROUND OF THE INVENTION

Printing machines capable of producing high speed, high quality media, promotional literature, books, packaging and the like, are common. The present invention generally relates to high speed printing machines and processes, and more particularly to offset printing machines and processes.

An offset printing machine typically includes several drums or "cylinders" that are rotatably mounted on a framework, with the rotational axes of the cylinders substantially parallel to one another. The drive mechanisms for the cylinders are typically interconnected by gears, etc. so as to rotate the cylinders together. The paper, cardboard, etc. (occasionally referred to herein as the "substrate") is automatically fed into the machine and processed by the various cylinders to produce the desired result.

One of the cylinders in a typical offset printing machine is the plate cylinder. It carries a metal plate that has been photographically etched or otherwise processed to reproduce the image of the text and/or graphics to be transferred to the substrate. As the plate cylinder rotates it is inked, and the image is transferred to a so-called blanket cylinder which in turn transfers the image to the substrate. The blanket cylinder carries a sheet-like "blanket," oftentimes made of rubber or some other polymeric material, which accepts the image from the plate cylinder and presses the image onto the substrate. In addition, a typical offset printing machine will include a coater apparatus for applying any of a wide variety of coatings, e.g., waterproofing, to the substrate. When a job requires coating, the coater apparatus is shifted into direct contact with the blanket cylinder while the plate cylinder is not operable to transfer ink images to the rubber surface. As an alternative to this arrangement (wherein the blanket cylinder is part of the printing unit and is used just for coating while the plate cylinder is not in service), the blanket cylinder can be part of an inline coating unit constructed independently of the printing unit to provide inline coating reproduction. Given these alternative approaches, the terms "blanket" or "printing blanket" are used below to refer to any blanket used in a printing machine, whether the blanket is arranged to interact with the plate cylinder, or whether the blanket is part of a separate inline coating unit.

On occasion, it is desired to use the coater to selectively coat only portions of the substrate. Or, it is sometimes desired to apply coating to most of the substrate, but to not coat certain select portions of the substrate, e.g., where an adhesive is to be applied, or where there are symbols or UPC codes that need to be scanned, or an area that includes mail metering information. When it is desired to not coat select portions of the substrate, the operator typically cuts out or relieves the blanket in those areas, so that the waterproofing (for example) is not applied in those select areas. Usually this is done after the blanket is installed on its cylinder, and historically the installed blanket is cut freehand with a small knife, e.g., an "X-Acto" knife. This freehand cutting technique is time consuming and often inaccurate, resulting in spoilage of the blanket.

The present invention addresses the blanket cutting problem discussed above, and presents a cost-effective method and apparatus for cutting a mounted printing blanket in a manner that is faster and more accurate than by freehand.

SUMMARY OF THE INVENTION

The apparatus of the present invention is a blanket cutter for cutting a printing blanket having a cylinder axis, including an elongated rail arranged substantially parallel to the cylinder axis and a blanket cutting device slidably engaged with the rail. An axial/horizontal blanket cut can be made by operatively engaging the printing blanket with the blanket cutting device and axially sliding the cutting device along the rail. A circumferential/vertical blanket cut can be made by operatively engaging the printing blanket with the blanket cutting device and effecting relative rotational movement, about the cylinder axis, between the printing blanket and the blanket cutting device.

In a preferred embodiment, the printing blanket is rotationally supported by a framework, and the elongated rail is a separate structure which is secured to the framework. Also, preferably, a circumferential/vertical blanket cut can be made by rotating the printing blanket relative to a rotationally stationary blanket cutting device.

In addition, the elongated rail can form a slot which slidably receives the blanket cutting device, wherein the rail is metal and at least a portion of the blanket cutting device is plastic, to reduce friction. Preferably the rail slot and the plastic portion of the blanket cutting device are "T-shaped" to eliminate unwanted motion therebetween but freely permit axial sliding motion of the blanket cutting device on the rail.

Also, a preferred blanket cutting device can include a knife having a blade that makes physical contact with the printing blanket to make the cuts. The knife can be rotated or twisted about its axis to change the blade orientation depending on whether a circumferential or axial blanket cut is desired. A threaded adjustment knob can selectively engage the knife to lock it in place in the desired orientation.

Since the depth of the blanket cut is often critical, a preferred apparatus according the present invention includes an adjustable collar that attaches to the tail end of the knife to act as a "stop," so that the depth of cut will not change as the knife is rotated when the cut direction is changed, for example.

The method of the present invention broadly includes the steps of selecting an elongated rail, positioning the rail parallel to the printing blanket cylinder axis, selecting a blanket cutting device, operatively engaging the printing blanket with the blanket cutting device, axially sliding the blanket cutting device along the rail to axially cut the blanket, and effecting relative rotational movement between the printing blanket and the blanket cutting device to circumferentially cut the blanket.

In a preferred method, the step of effecting relative movement between the printing blanket and the blanket cutting device includes rotating the printing blanket about the cylinder axis.

In another preferred method, the step of selecting the elongated rail includes selecting a structure that is separate from the framework or catwalk; and the step of positioning the rail comprises attaching the rail to the framework.

A preferred method is also characterized in that the blanket cutting device includes a knife blade, and the step of operatively engaging the printing blanket with the blanket cutting device includes placing the knife blade into physical contact with the blanket.

Finally, in preferred printing blanket methods according to the present invention the rail forms a slot and the blanket cutting device includes an extending element that fits within and conforms to the slot; and wherein the slot and extending element are T-shaped.

BRIEF DESCRIPTION OF THE DRAWINGS

The invention will be further described with reference to the Drawing, wherein.

DETAILED DESCRIPTION OF PREFERRED EMBODIMENTS

Figure 1:
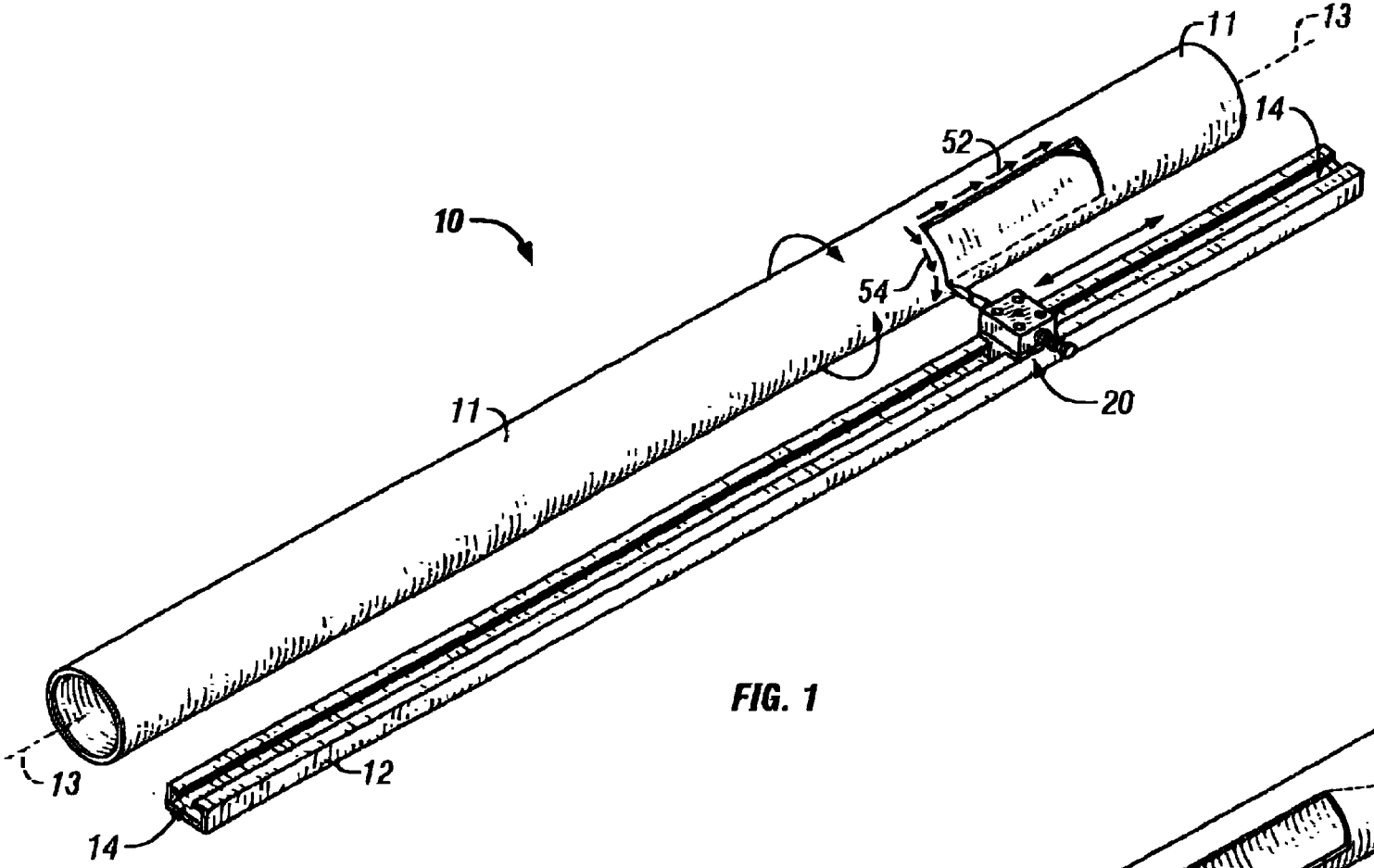
FIG. 1 is a perspective view of a preferred blanket cutter in accordance with the teachings of the present invention, shown in use with a blanket cylinder.

With reference to the attached Drawing, wherein like reference numerals represent like parts and assemblies throughout the several views, FIG. 1 shows a preferred blanket cutter 10 according to the present invention, mounted adjacent a printing blanket 11 used to apply a coating to a substrate (not shown). As alluded to above, the blanket 11 could be any blanket used in a printing machine, whether arranged to interact with a plate cylinder (not shown), or alternatively as part of a separate inline coating unit. Blanket 11 is occasionally referred to herein as cylinder 11, and as those skilled in the art understand, blanket 11 is typically a rubber or other polymeric sheet-like material mounted on a cylinder. Cylinder 11 rotates about a cylinder axis 13 which is stationary relative to a catwalk or framework 15 shown schematically in the drawing.

Figure 4:
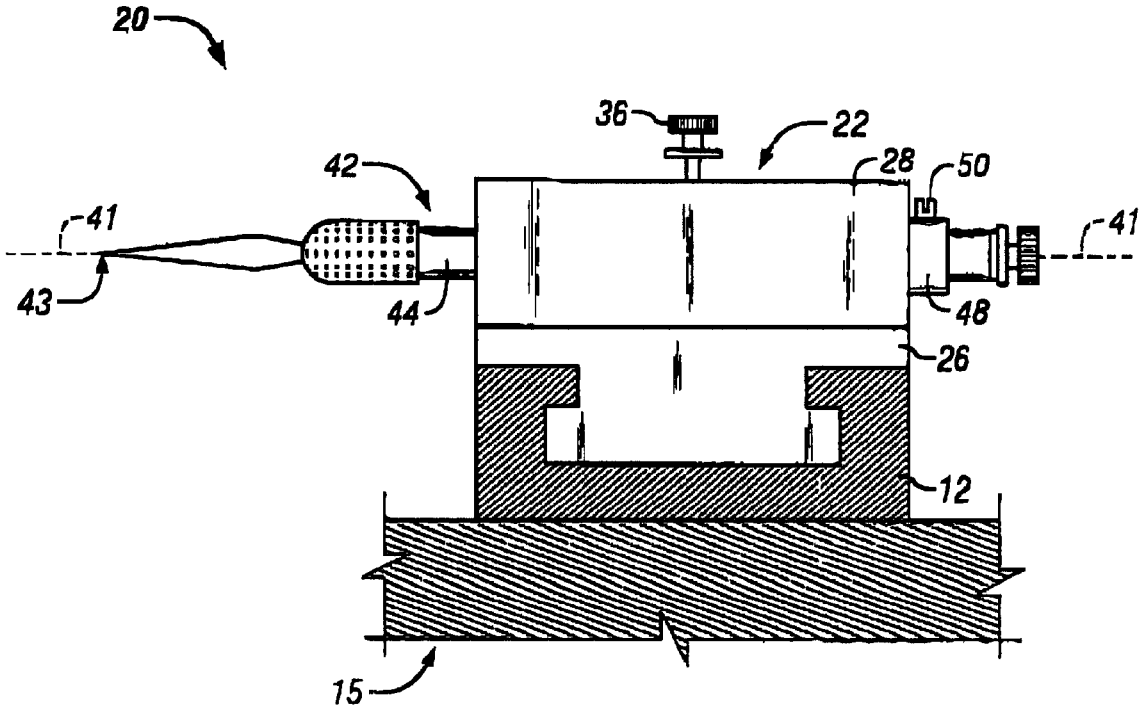
FIG. 4 is an enlarged side elevational view of the cutter assembly mounted in the rail.
Figure 5:
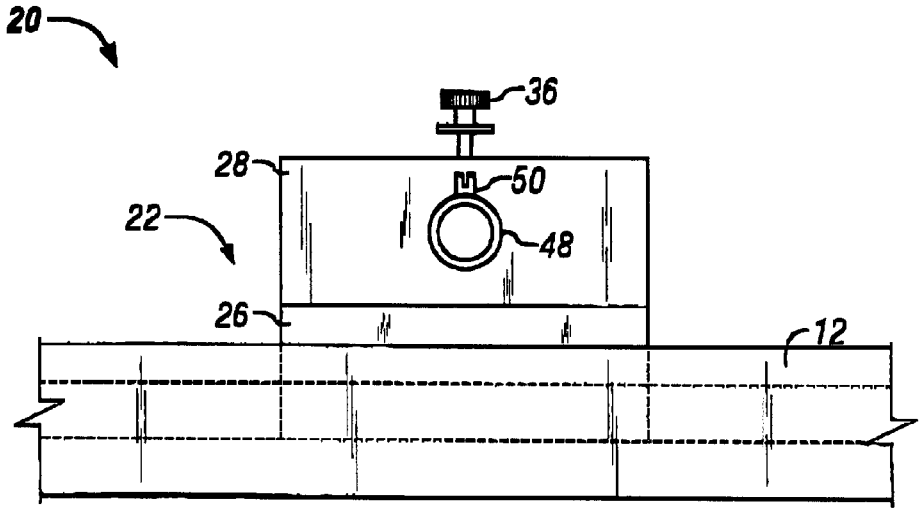
FIG. 5 is an enlarged rear elevational view of the cutter assembly mounted in the rail.

Blanket cutter 10 includes a long metal rail or slider 12 having an inverted T-shaped slot 14 formed in its upper surface. Viewed at either end of rail 12, e.g., see FIG. 4, slot 14 has a relatively wide lower portion or base; and a relatively narrow upper portion or neck, for purposes discussed above. Rail 12 could be made from any of a variety of materials, for example steel that has been appropriately milled; or aluminum that has been milled or extruded. Rail 12 can be any convenient length, depending on the length of the printing or coating cylinder(s) with which it is intended to operate. A preferred length for this embodiment is 40 inches, with a width of 3 inches. The neck of slot 14 can have a width of 1.5 inches, and the slot can have a depth of 0.625 inch. The base of slot 14 can have a width of 2 inches. A lower surface 16 of rail 12 can form a plurality of spaced chambered holes (not shown), suitable for accepting flat headed threaded fasteners used to secure blanket cutter 10 to the catwalk or other underlying superstructure 15. An upper surface 18 of rail 12 slidably supports other portions of blanket cutter 10, as further discussed below. It should be noted that the rail could alternatively be integrally formed with or by the framework or catwalk 15, as opposed to being a separate part attached to the framework or catwalk 15, as shown in the drawing and described above.

Slidably mounted on rail 12 is a cutter assembly 20 having a puck or slider assembly 22 and a tramming gauge or knife 24. Puck assembly 22 has a plastic lower puck 26 and metal upper puck 28. Lower puck 26 is somewhat anvil shaped, having a relatively wide rectangular top that is supported on its underside by rail upper surface 18; a relatively narrow neck portion that slidably fits within the neck of the T-slot 14; and a relatively wide bottom portion that is shaped to conform to and slidably fit within the lower portion of T-shaped slot 14. The flat top surface of lower puck 26 is connected to the rectangular upper puck 28 by means of a plurality of threaded fasteners 30 shown in FIG. 3. Lower puck 26 is made of plastic to reduce friction between its male "T" structure and the mating female "T" shape of T-slot 14; and similarly to reduce friction between the puck assembly 22 and the top surface 18 of rail 12. Any of a wide variety of plastic materials can be used to fabricate lower puck 26, e.g., Delrin or the like. The dimensions of lower puck 26 are consistent with (but of course slightly smaller than) those of corresponding surfaces, etc. of T-slot 14, so as to create a sliding fit with no appreciable play or looseness.

Figure 3:
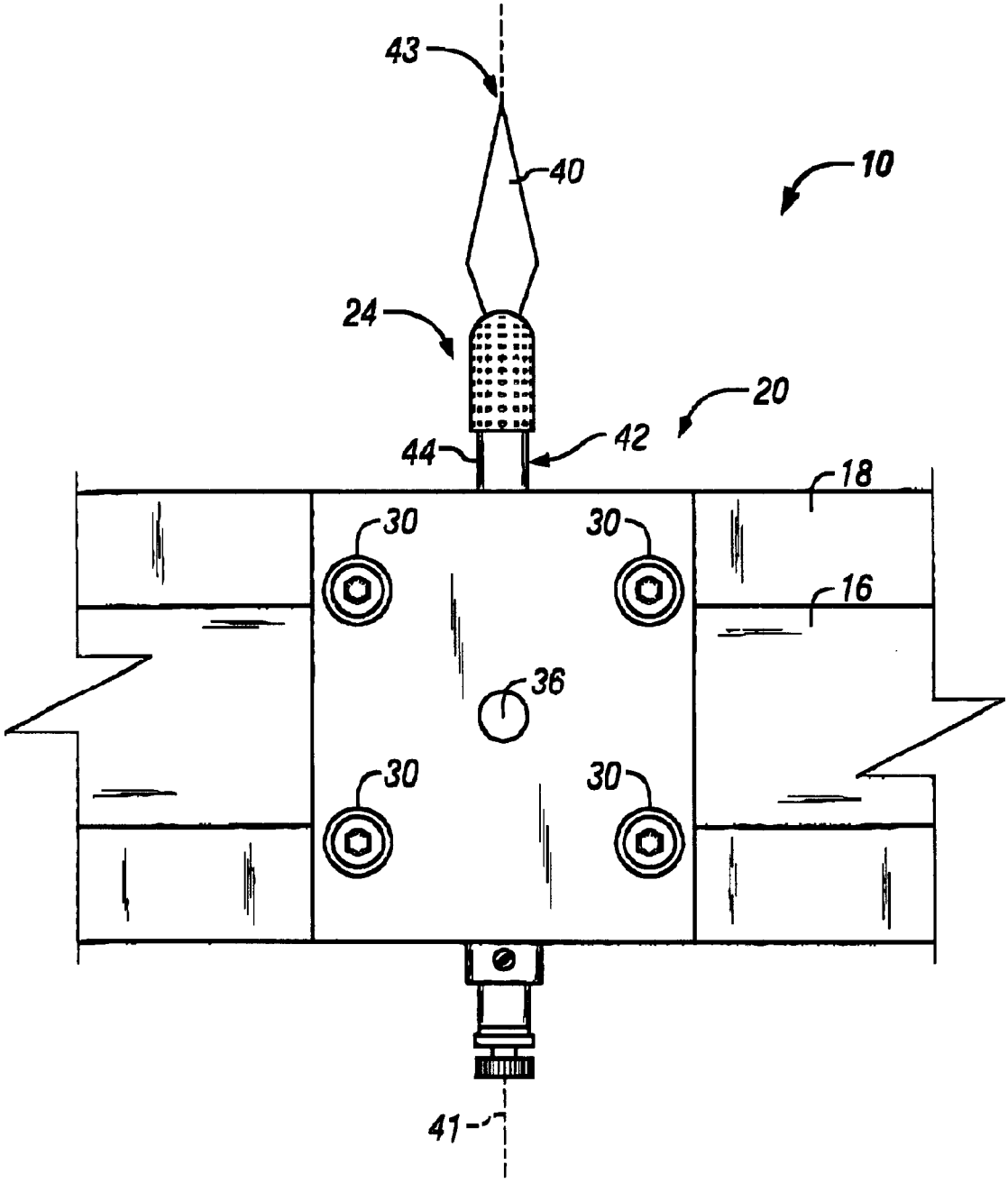
FIG. 3 is an enlarged partial top plan view of the blanket cutter of FIG. 1, illustrating in particular the cutter assembly and a portion of the rail.

Upper puck 28, constructed of metal, is affixed to and supported by lower puck 26, through the use of fasteners 30. Upper puck 28 is preferably 3 inches by 2.5 inches, when viewed from the top (e.g., FIG. 3), with the 3 inch dimension corresponding to the width of the rail 12. It is 1 inch thick, as viewed in FIG. 4. A 5/16 inch hole is bored fore-and-aft through upper puck 28 to slidably accept tramming gauge (knife) 24. This hole extends perpendicularly through the front and rear surfaces of upper puck 28, so that when cutter assembly 20 is mounted in rail 12 knife 24 is perpendicular to the rail 12. It is also vertically drilled and tapped, at its center (when viewed from the top), to accept a threaded adjustment knob 36. The hole for adjustment knob 36 aligns with and intersects the fore-and-aft hole for the tramming gauge 24, for reasons discussed below. Tramming gauge 24 is preferably a knife of the "X-Acto" variety. Knife 24 has a sharpened, pointed blade 40 which can be generally symmetrical side to side thereof, as shown in FIG. 3. Blade 40 is held by an elongated, round handle 42 having a head which accepts blade 40 and a tail that extends through the opposite end of upper puck 28. Handle 42 has a smooth intermediate portion or barrel 44 that slidably fits within the horizontal fore-and-aft hole bored in upper puck 28. Although the fit permits sliding and twisting of knife 24 within upper puck 28, the fit is close enough to preclude looseness or inadvertent movement of knife 24 within upper puck 28 once the adjustment knob 36 has been tightened, as discussed further below.

An adjustable collar 48 slidably fits on the tail end of knife 24, and collar 48 includes a small set screw 50 that can be tightened to secure collar 48 to knife 24. Collar 48 can be moved axially along the barrel of knife 24, to adjust the precise distance that blade 40 extends forwardly out of puck assembly 22, as discussed further below.

Adjustment knob 36 can be loosened to permit knife 24 to be twisted about a knife longitudinal axis 41, and to permit knife 24 to move in and out (fore and aft), relative to puck 22. Screw 50 can be loosened to permit collar 48 to be repositioned on the barrel of the knife, so as to form an adjustable "stop" to ensure that knife 24 always returns to the same fore-and-aft position even after it is twisted to reorient the blade, thereby maintaining a uniform depth of blanket cut, as further discussed below.

Those skilled in the art will appreciate that it would be possible to "cut" a blanket in alternative ways and still fall within the confines of the present invention, as set forth in the claims attached hereto. For example, it is possible that the blanket could be cut using heat or even a laser, but certainly it is more typical and common to literally use a knife, as described herein.

To install blanket cutter 10, the first step is to take the coating unit and packing off of the press (not shown). The catwalk or support structure 15 of the coating unit is squared and leveled. Blanket cutter 10 is placed on the catwalk 15 and centered and squared relative to the blanket cylinder 11. The tramming gauge or knife 24 is secured within upper puck 28 by means of adjustment knob 36, and set at a relatively withdrawn position (since it is not yet time to actually cut the blanket). The puck assembly 22 is then engaged into rail 12, slidably mating the male and female T-shaped structures. The distance of the rail 12 from the cylinder 11 is set evenly by sliding the puck assembly 22 from one end of rail 12 to the other and observing the distance of the forward tip of the knife blade 40 from the surface of blanket 11. Either end of rail 12 can be moved toward or away from the cylinder 11 so that the blade 40 is a uniform distance from the blanket 11 as puck assembly 22 is slid back and forth. Once the distance is uniform from side to side, a marker can be used to mark mounting holes on the catwalk 15, through the mounting holes (not shown) in the base or lower surface 16 of the rail 12. The blanket cutter 10 can then be removed, and the mounting holes in the catwalk 15 drilled out. The cutter assembly is again positioned on the catwalk 15 with the mounting holes in the rail 12 aligned with the corresponding mounting holes in the catwalk 15. Then, the puck assembly 22 can be reinstalled within rail 12 to square the cutter assembly relative to the cylinder 11 by once again sliding the puck back and forth along the entire length of the rail 12 and observing the distance between the forward tip of the knife and the blanket 11. After the cutter is again squared up, flathead bolts and nuts (not shown) can be used to secure the rail 12 to the catwalk 15, and then rechecked to ensure that the cutting assembly is square relative to the blanket cylinder 11. This process, along with the geometry of blanket cutter 10, ensures that rail 12 is parallel to rotational axis 13 of cylinder 11; and that knife axis 41 is perpendicular to the surface of blanket 11. It is also preferred that the height of blanket cutter 10 be adjusted relative to cylinder 11 so that knife axis 41 passes substantially through blanket cylinder axis 13, again to ensure a true, precise cut of blanket 11. Height adjustment can be achieved by using spacers or the like if necessary.

In operation, the first step is to print on the coating unit without coating. After the job is in position on the press, the next step is to cut the blanket 11 using the blanket cutter 10. The cutter assembly 20 is slid along the rail 12 so as to align the tip of the knife blade 40 with the location of the first cut. It is preferable to use a particular cutting pattern, described below. It should be noted that typically the cuts are either axial or circumferential (i.e., horizontal or vertical in most situations), resulting in rectangular cutouts having sides that are parallel to the sides of the substrate; but it is contemplated that more complex cuts could conceivably be made by simultaneously moving the cutting device and the blanket cylinder.

Further with regard to the operation of the present invention, the depth of the blade is adjusted by loosening the adjustment knob 36 on top of the puck. The knife 24 is moved, either forward or backward, to adjust the depth of the blade. The handle at the tail end of the knife is grasped to make the adjustments. Once the depth is adjusted properly, the adjustment knob is tightened to lock the knife within the puck. The collar 48 can then be set, by loosening the set screw 50; pushing collar 48 up against the back of the puck; and retightening set screw 50, to establish a depth "stop" on the knife, so that the knife can always be returned to the same depth, fore-and-aft, after twisting the knife to reorient the blade, by simply pushing the knife all the way forward, against the stop, prior to retightening adjustment knob 36.

The cutting pattern illustrated by arrows 52 and 54 in FIG. 1 is preferred. Horizontal or axial cuts are made by moving the puck assembly 22 from left to right, as illustrated by arrows 52. Vertical or circumferential cuts, per arrows 54, are made from top to bottom by rotating the cylinder away from the operator (assuming the operator is standing near the tail end of the knife 24, facing the cylinder 11). To reorient the knife blade 40, the adjustment knob 36 on top of the puck is loosened and the knife is rotated 90 degrees about its axis 41, the knife is pushed forwardly against the stop created by collar 48, and then adjustment knob 36 is re-tightened, thus placing the blade 40 in its proper orientation for the next cut but at the same time maintaining exactly the same depth of cut. As well known to those skilled in the art, the reason for reorienting the knife blade is to align the opposing flat surfaces of the blade with the direction of the cut. Thus, FIG. 1 shows the knife oriented in such a way as to permit a horizontal cut. Twisting the knife 90 degrees in either direction (after loosening adjustment knob 36) would orient the blade for a vertical cut.

It will be understood that knife 24 can be reoriented 90 degrees without withdrawing it from a position relative to blanket cylinder 11. Such a reorientation without withdrawal can be facilitated by employing a knife 24 which has a tip 43 which is located on knife longitudinal axis 41. As a result, tip 43 will not be revolved eccentrically about axis 41 during rotation. As a consequence, undue damage to the blanket cylinder 11 will not occur.

Figure 2:
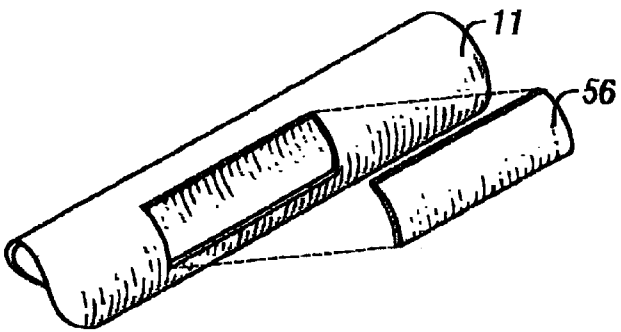
FIG. 2 is a perspective view of a portion of the blanket cylinder of FIG. 1, following the cutting operation, illustrating the removal of the cut portion of the blanket.

After the blanket has been completely cut, a small screwdriver or the like (not shown) is used to lift a corner of the cutout 56 (see FIG. 2). The cutout 56 is grasped and lifted to peel the blanket back. It should be noted that only selected layers of the blanket are sometimes removed, in effect creating a relieved area in the blanket as opposed to removing all of the layers of the blanket. Thus, the term "cutout", as used herein, includes a complete cutout but also a partial cutout or relief in the blanket. A typical cutout might have dimensions of a couple of inches across and an inch high (with reference to FIG. 2), but in actual practice the cutout can be any size, depending on the application.

It should also be noted that those skilled in the art will appreciate that circumferential (i.e., vertical, normally) cuts in the blanket could be created by in effect pivoting the rail (carrying the cutting assembly) about the cylinder axis while keeping the cylinder stationary; as opposed to rotating the cylinder relative to a catwalk-mounted rail as shown and described in detail herein. Both methods are contemplated herein. Of course, the "pivoting rail" briefly disclosed above would require that the rail not be affixed to the catwalk, but rather somehow pivoted about the cylinder axis.

The advantages of the present invention are now apparent. Instead of holding a knife manually and attempting a freehand cut, as was typically done in the past, the apparatus according to the present invention holds the knife square and true and at a precise depth, relative to the blanket, thus creating a precise, accurate cut, from side to side, top to bottom, and in terms of the depth. The resulting cutout is sharper, and can be done faster than with the freehand method. This results in less downtime for the press, and reduces or eliminates blanket spoilage.

Preferred embodiments of the invention are described above. Those skilled in the art will recognize that other embodiments are possible within the scope of the invention. Variations and modifications of the various parts and assemblies can certainly be made and still fall within the scope of the invention. Thus, the invention is limited only to the apparatus and method recited in the following claims, and equivalents thereto.

What is claimed is:

1. A blanket cutter assembly comprising:

(a) a rotatable cylinder having an axis for mounting a printing blanket having an outer surface and blanket body;

(b) an elongated rail having a longitudinal slot;

(c) a framework for mounting the cylinder and the rail substantially in parallel and spaced apart at a predetermined distance;

(d) a knife including a cutting blade and a barrel having a head and a tail for carrying the blade on the head wherein the blade includes a blade surface and a tip for cutting through the outer surface and into the blanket body;

(e) a puck having a friction-reducing lower plastic rail engaging portion having a depending element for slidably moving the puck within the longitudinal slot and an upper knife holding portion for mounting the knife;

(f) the upper knife holding portion having a bore for receiving the knife barrel for maintaining the knife longitudinal axis perpendicular to the outer surface of the blanket and an adjustment screw disposed transverse to the knife longitudinal axis for selectively pressing against the knife barrel within the bore to selectively and adjustably rotate and lock the knife in at least a first orientation wherein the cutting blade surface is parallel to a plane passing through the cylinder axis and a second orientation perpendicular to both the plane and the first orientation;

(g) an adjustable stop having a collar and a set screw engaged thereto and connected to the tail of the knife barrel for axially positioning the barrel within the bore for setting the depth of cut;

(h) means to rotate the cylinder for cutting the blanket in a circumferential direction while the blade is in the second orientation and stationary on the rail.

* * * * *